US007111839B2

(12) United States Patent
Nishimura

(10) Patent No.: US 7,111,839 B2
(45) Date of Patent: Sep. 26, 2006

(54) SHEET STACKING DEVICE AND IMAGE FORMING APPARATUS

(75) Inventor: Shunsuke Nishimura, Ibaraki-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 19 days.

(21) Appl. No.: 10/986,995

(22) Filed: Nov. 15, 2004

(65) Prior Publication Data

US 2005/0104270 A1 May 19, 2005

(30) Foreign Application Priority Data

Nov. 17, 2003 (JP) ..... 2003-386394
Oct. 6, 2004 (JP) ..... 2004-293602

(51) Int. Cl.
*B65H 39/02* (2006.01)

(52) U.S. Cl. ..... 270/58.23; 270/58.01; 270/58.08; 270/58.11; 270/58.14

(58) Field of Classification Search ..... 270/58.23, 270/58.01, 58.08, 58.11, 58.14
See application file for complete search history.

(56) References Cited

U.S. PATENT DOCUMENTS 5,112,034 A * 5/1992 Uto et al. ..... 270/58.12
5,765,824 A * 6/1998 Kawano et al. ..... 270/58.11
6,199,850 B1 * 3/2001 Seki ..... 270/58.07
6,332,606 B1 12/2001 Seki ..... 270/59
6,845,228 B1 1/2005 Suzuki et al. ..... 399/407
2002/0190456 A1 * 12/2002 Miyake et al. ..... 270/58.08
2004/0178572 A1 9/2004 Nishimura et al. ..... 271/298

FOREIGN PATENT DOCUMENTS

JP 2002-154731 5/2002

* cited by examiner

*Primary Examiner*—Gene O. Crawford
*Assistant Examiner*—Leslie A. Nicholson, III
(74) *Attorney, Agent, or Firm*—Fitzpatrick, Cella, Harper & Scinto

(57) ABSTRACT

The present invention relates to a sheet stacking device which stacks sheets thereon, comprising: a buffer unit which allows a preceding sheet to temporarily stay so as to superimpose the preceding sheet and a following sheet one on another; a sheet discharging roller which discharges the sheets superimposed in the buffer unit; and a sheet stacker which stacks the sheets discharged from the buffer unit. The sheets to be discharged in superimposition by the sheet discharging roller is superimposed in a state in which a rear end of a lower sheet in a sheet conveying direction advances in the sheet conveying direction more than a rear end of an upper sheet, and the lower sheet is previously discharged to the sheet stacker.

7 Claims, 3 Drawing Sheets

SHEET STACKING DEVICE AND IMAGE FORMING APPARATUS

BACKGROUND OF THE INVENTION

1. Field of the Invention

The present invention relates to a sheet stacking device equipped with a buffering function and an image forming apparatus provided with the sheet stacking device. Here, an image forming apparatus according to the present invention signifies apparatuses including a sheet stacking device and an image forming apparatus main body.

2. Related Background Art

Conventional image forming apparatuses such as a copying machine include an apparatus in which a sheet having an image formed in an image forming unit is subjected to post-processing. The post-processing is exemplified by that a sheet having an image formed thereon is temporarily stacked on a intermediate-processing tray, followed by stapling processing, before a set of sheets is stacked on a stack tray.

In the case where the stapling processing is performed, a sheet discharged from the image forming apparatus is first stacked on the intermediate-processing tray, followed by the stapling processing after all of the sheets are stacked on the intermediate-processing tray. The set of sheets subjected to the stapling processing is discharged to the stack tray, and then, a first sheet out of a next set of sheets is stacked on the intermediate-processing tray.

Here, in comparison of a time of period during which the set of sheets is stacked on the intermediate-processing tray in the case where the stapling processing is performed with a time of period in the case where no stapling processing is performed, the time of period in the case where the stapling processing is performed becomes longer by the time of period taken for the stapling processing.

In other words, a sheet for a next job cannot be stacked on the intermediate-processing tray during the stapling processing. In view of this, in the case of the continuous stapling processing, an interval between the last sheet of the preceding set of sheets and the first sheet of the following set of sheets is lengthened by delaying the feeding of a first sheet for the next job. As a consequence, the productivity at the time of the stapling processing is degraded more than that at the time of no stapling processing.

In order to solve the above-described problem, there has been conventionally proposed and provided an apparatus equipped with a buffering function of allowing a sheet being conveyed to temporarily stay so as to stack the sheet on a intermediate-processing tray with a delay while keeping the productivity of image formation (see Japanese Patent Application No. 2000-352923). However, a space is required for disposing a special buffer path inside of the apparatus, thereby making it difficult to reduce the size of the apparatus. In contrast, although the above-described configuration may be achieved if a sheet stacking device is installed outside of the image forming apparatus, even in this case, it has been difficult to incorporate the sheet stacking device provided with the buffer path inside of the image forming apparatus.

In addition, in the case where the sheets subjected to buffering processing are discharged to the intermediate-processing tray in superimposition, it has been difficult to align the sheets in superimposition, in particular, to secure the alignment of the sheets stacked downward.

SUMMARY OF THE INVENTION

An object of the present invention is to provide a sheet stacking device, in which post-processing such as stapling processing can be performed while securing favorable alignment without degrading productivity, and further, can be incorporated in an image forming apparatus owing to miniaturization, and an image forming apparatus provided with the sheet stacking device.

In order to achieve the object, a typical configuration of an image forming apparatus according to the present invention provided with a sheet stacking device which stacks sheets thereon, comprises: a buffer unit which allows a preceding sheet to temporarily stay so as to superimpose a following sheet on the preceding sheet; a sheet discharging roller which discharges the sheets superimposed in the buffer unit; and a sheet stacker which stacks the sheets discharged from the buffer unit; wherein the sheets to be discharged in superimposition by the sheet discharging roller are superimposed in a state in which a rear end of a lower sheet in a sheet conveying direction advances in the sheet conveying direction more than a rear end of an upper sheet, and the lower sheet is previously discharged to the sheet stacker.

According to the present invention, it becomes unnecessary to lengthen an interval between a last sheet out of a set of sheets to be subjected to post-processing and a first sheet of a next set of sheets more than a sheet interval at the time of no post-processing by performing buffering processing with respect to a sheet following a set of sheets to be subjected to post-processing such as stapling processing. Consequently, it is possible to suppress the degradation of the productivity at the time of the post-processing. Furthermore, the tip of a lower sheet out of the two sheets superimposed by the buffering processing is made to advance more than the tip of an upper sheet, thereby achieving favorable alignment in sheet conveying direction on an intermediate-processing tray. Moreover, since the reversing path for forming images on both sides of the sheet is used as a buffer path, the sheet stacking device can be miniaturized without providing any special buffer path. Thus, the post-processing such as the stapling processing can be performed while securing the favorable alignment without degrading the productivity, and further, the sheet stacking device can be miniaturized, thus providing the sheet stacking device which can be incorporated in the image forming apparatus, and the image forming apparatus provided with the sheet stacking device.

DETAILED DESCRIPTION OF THE PREFERRED EMBODIMENTS

A description will be given below of a sheet stacking device and an image forming apparatus in a preferred embodiment according to the present invention. In the present preferred embodiment, the sheet stacking device is installed in the image forming apparatus, to thus perform the processing of a sheet to be discharged from the image forming apparatus.

Figure 1:
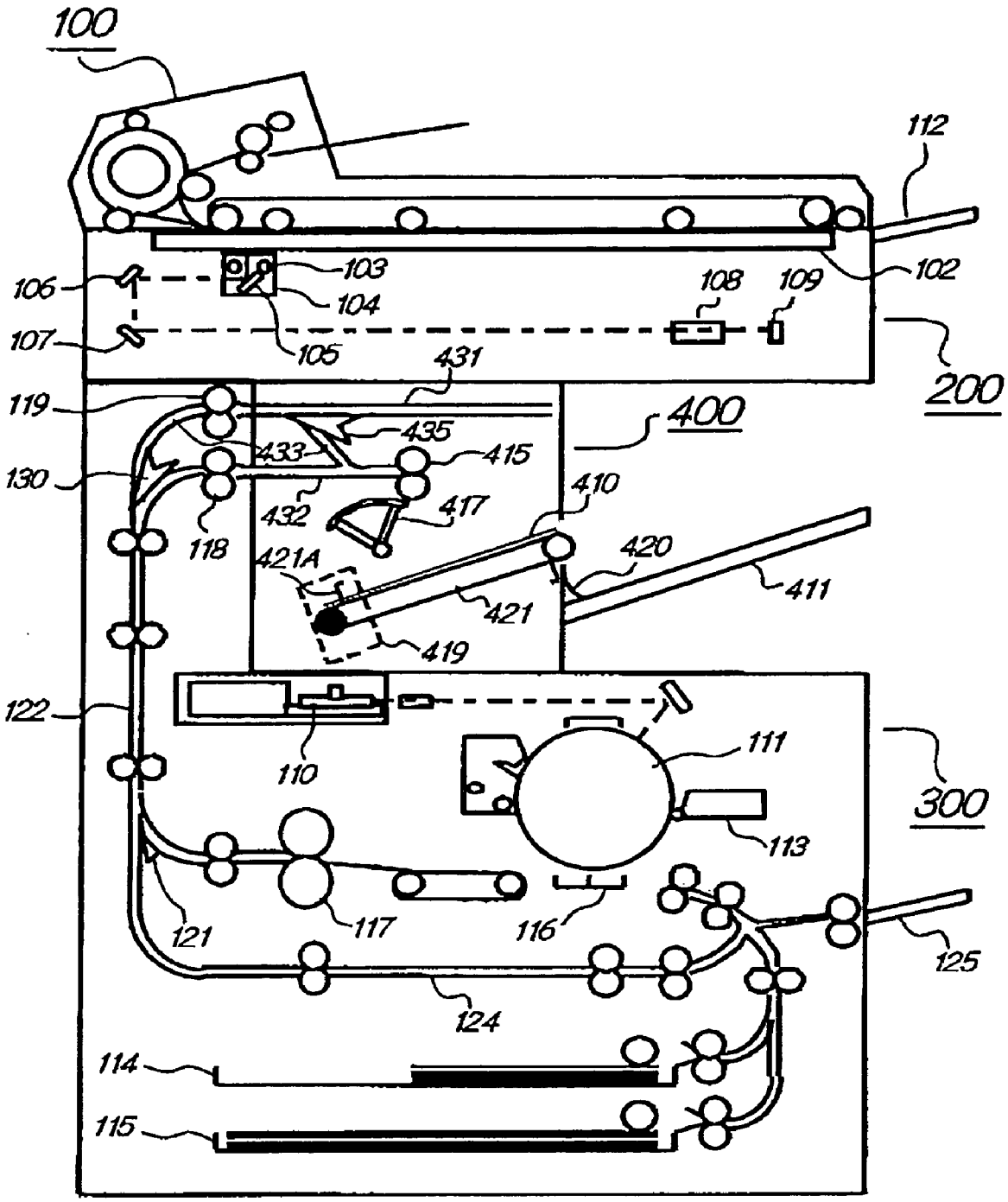
FIG. 1 is a view showing the configuration of an image forming apparatus in a preferred embodiment.

First of all, explanation will be made on an image forming apparatus main body. FIG. 1 is a view showing the configuration of the image forming apparatus and the sheet stacking device.

The image forming apparatus comprises an image reader 200 and a printer 300. The image reader 200 includes a document feeder 100. The document feeder 100 separates documents, which are placed upward, feeds the documents one by one in order from a document of a first page leftward in FIG. 1, conveys the document onto a platen glass 102 via a curved path, and discharges the document to a discharge tray 112 after the document is read. The image reader 200 reads the document by introducing a light beam reflected on the document into an image sensor 109 via mirrors 105, 106 and 107 and a lens 108 with irradiation of a light beam emitted from a lamp 103 in a scanner unit 104 onto the document.

An image of the document read by the image sensor 109 is subjected to image processing, and then, is sent to an exposure controller 110. The exposure controller 110 outputs a laser beam in response to an image signal. With the irradiation of the laser beam on a photosensitive drum 111, an electrostatic latent image is formed on the photosensitive drum 111. A developer 113 develops the electrostatic latent image on the photosensitive drum 111. Thereafter, a transfer unit 116 transfers a developing agent on the photosensitive drum 111 onto a sheet which is fed from any one of cassettes 114 and 115, a manual feeder 125 and a double-sided conveying path 124.

The sheet, onto which the developing agent is transferred, is subjected to fixing processing of the developing agent by a fixing unit 117. The sheet passing through the fixing unit 117 is introduced to a path 122 by a flapper 121, and then, is introduced to a pair of first discharging rollers 118 or a pair of second discharging rollers 119, which can be rotated forward or reversely, by switching another flapper 130 (i.e., a first switching flapper), before the sheet is discharged from the printer 300 with the side having the developing agent transferred thereonto facing downward (in face down). The discharge in face down can provide a set of sheets in the proper order of pages when the sheets having the images formed thereon are discharged and stacked in the order of pages.

The sheet discharged by the first discharging rollers 118 or the second discharging rollers 119 is fed into a finisher 400, in which stapling processing or the like is performed.

In the case of image formation on both sides of the sheet, an image is formed on one side of the sheet, and then, the sheet passing through the fixing unit 117 is introduced onto the path 122 via the flapper 121, and further, onto a reversing path 431 by switching the flapper 130 and another flapper 435 (i.e., second switching means). Thereafter, the second discharging rollers 119 are reversely rotated to be switched back, and thereafter, the sheet is introduced to the double-sided conveying path 124 by the flapper 121. The sheet introduced to the double-sided conveying path 124 is fed upside down to the photosensitive drum 111 again, and thus, an image is formed on the other side of the sheet.

In the present preferred embodiment, the reversing path 431 is arranged above a discharging path 432 (i.e., a first conveying path). Furthermore, the flapper 435 switches to selectively guide the sheet to a merging path 433 (i.e., a second conveying path) connecting from the second discharging rollers 119 to the discharging path 432. Here, the discharging path 432, the merging path 433 and the flapper 130 constitute a buffer unit in the present preferred embodiment.

According to the present invention, a sheet next to the sheet to be subjected to a job of the stapling processing is subjected to the buffering processing. The buffering processing signifies, for example, processing of allowing the next sheet to temporarily stay until the completion of the job of sheet processing such as the stapling processing. The sheet stacking device can be miniaturized without providing any special buffer path by performing the buffering processing by the use of the reversing path. Additionally, a time required for the stapling processing can be secured without changing a sheet feeding timing for a next job, thereby keeping the productivity of the image forming apparatus as a whole.

Here, a flow of sheets will be illustrated below when two sets of two sheets are subjected to the stapling processing.

Figure 2:
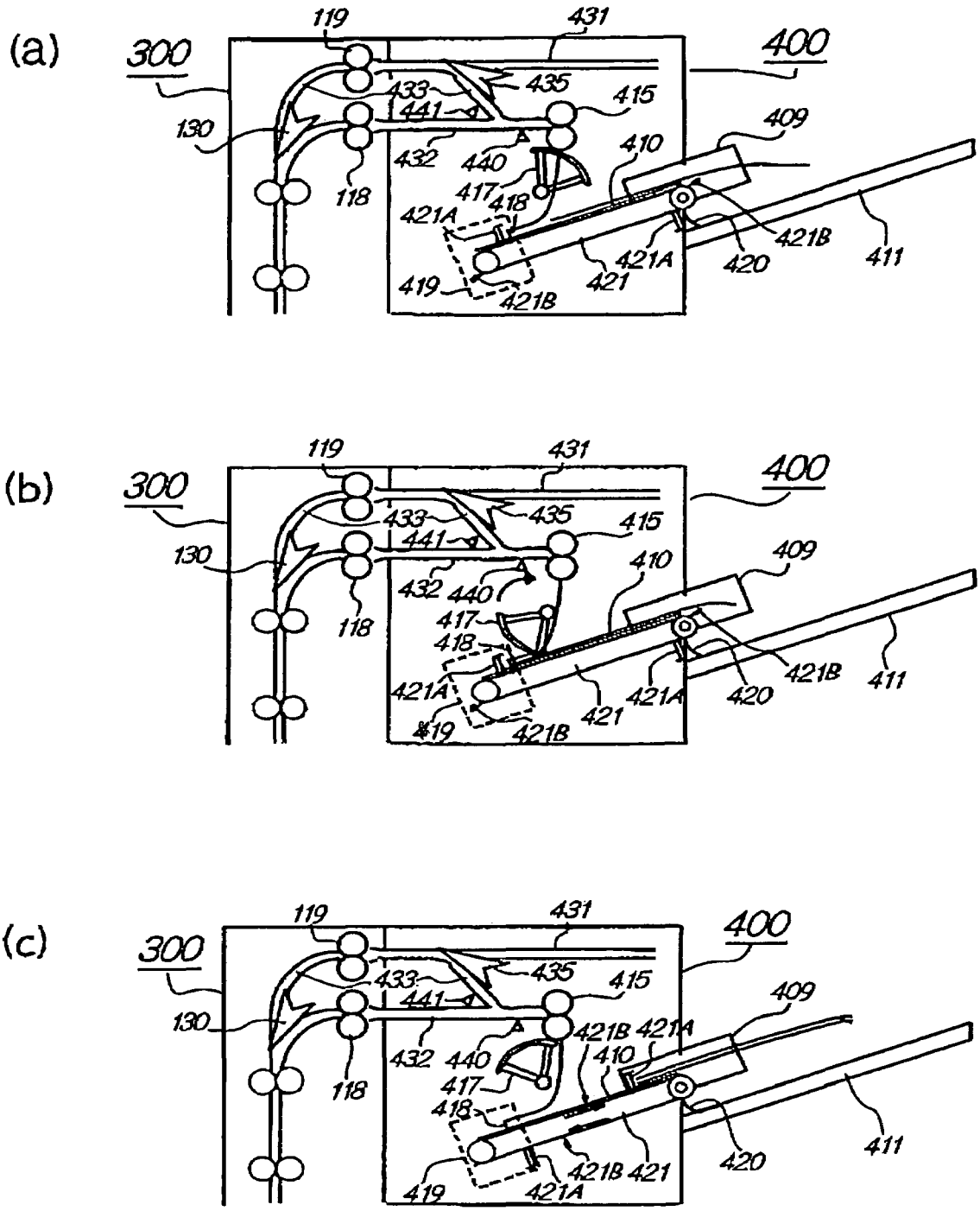
FIGS. 2A to 2C are views explanatory of a flow of a first set of sheets in stapling processing.

First, there will be illustrated a flow of a first set of two sheets. A first sheet received from the printer 300 is fed into discharging rollers 415 via the first discharging rollers 118 and the discharging path 432 by switching the flapper 130, and thereafter, is discharged onto a set-discharging belt 421 by the discharging rollers 415. An intermediate-processing tray 410 (i.e., sheet stacking means) of a low friction is disposed by several millimeters above and in parallel to the set discharging belt 421. Therefore, the sheet can be precisely placed on the intermediate-processing tray 410. As shown in FIG. 2A, the discharged sheet falls upstream in a sheet conveying direction (i.e., a lower left direction in FIG. 2A) along the intermediate-processing tray 410 (i.e., the set discharging belt 421) disposed slantwise. Furthermore, as shown in FIG. 2B, a frictional member disposed on an arc of a sectorial returning roller 417 is brought into contact with the sheet discharged onto the intermediate-processing tray 410 by the rotation of the returning roller 417, so that the sheet is moved upstream in the sheet conveying direction, and thus, the end of the sheet abuts against a stopper plate 418. In the same manner as the first sheet, a second sheet also is fed into the discharging rollers 415 via the first discharging rollers 118 and the discharging path 432, and then, is discharged onto the intermediate-processing tray 410 by the discharging rollers 415, and thus, the end of the sheet abuts against the stopper plate 418 by the returning roller 417.

Since the length of the intermediate-processing tray 410 may not be enough to stack the sheets thereon, a intermediate-processing tray stack auxiliary plate 421B is disposed in the set discharging belt 421, so as to compensate the length of a sheet stacking surface of the intermediate-processing tray 410. Aligning plates 409 are arranged on both sides (i.e., on a front side and a back side in the drawings) along the sheet conveying direction of the intermediate-processing tray 410, to thus align the sheets on the intermediate-processing tray 410 in a direction perpendicular to the sheet conveying direction. A staple unit 419 is disposed on the front side in the drawings, and thus, subjects the two sheets on the intermediate-processing tray 410 to the stapling processing.

Upon completion of the stapling processing, the sheets on the intermediate-processing tray 410 are discharged onto a stack tray 411 by a set discharging lever 421A disposed at the set discharging belt 421, as shown in FIG. 2C. The set discharging lever 421A pushes up the sheets by turning the set discharging belt 421 in the sheet conveying direction, and then, discharges the sheets onto the stack tray 411. Incidentally, the set discharging lever 421A is moved inside of a cutout, not shown, formed at the intermediate-processing tray 410. The stack tray 411 is lifted up or down according to the quantity of stacked sheets. Moreover, the upper surface of the sheet is pressed by a sheet pressing member 420 by lifting up or down the stack tray 411 by a predetermined quantity after the sheets are discharged onto the stack tray 411. Consequently, it is possible to prevent the sheets from being pushed out in the conveying direction by sheets subsequently discharged onto the stack tray 411.

Figure 3:
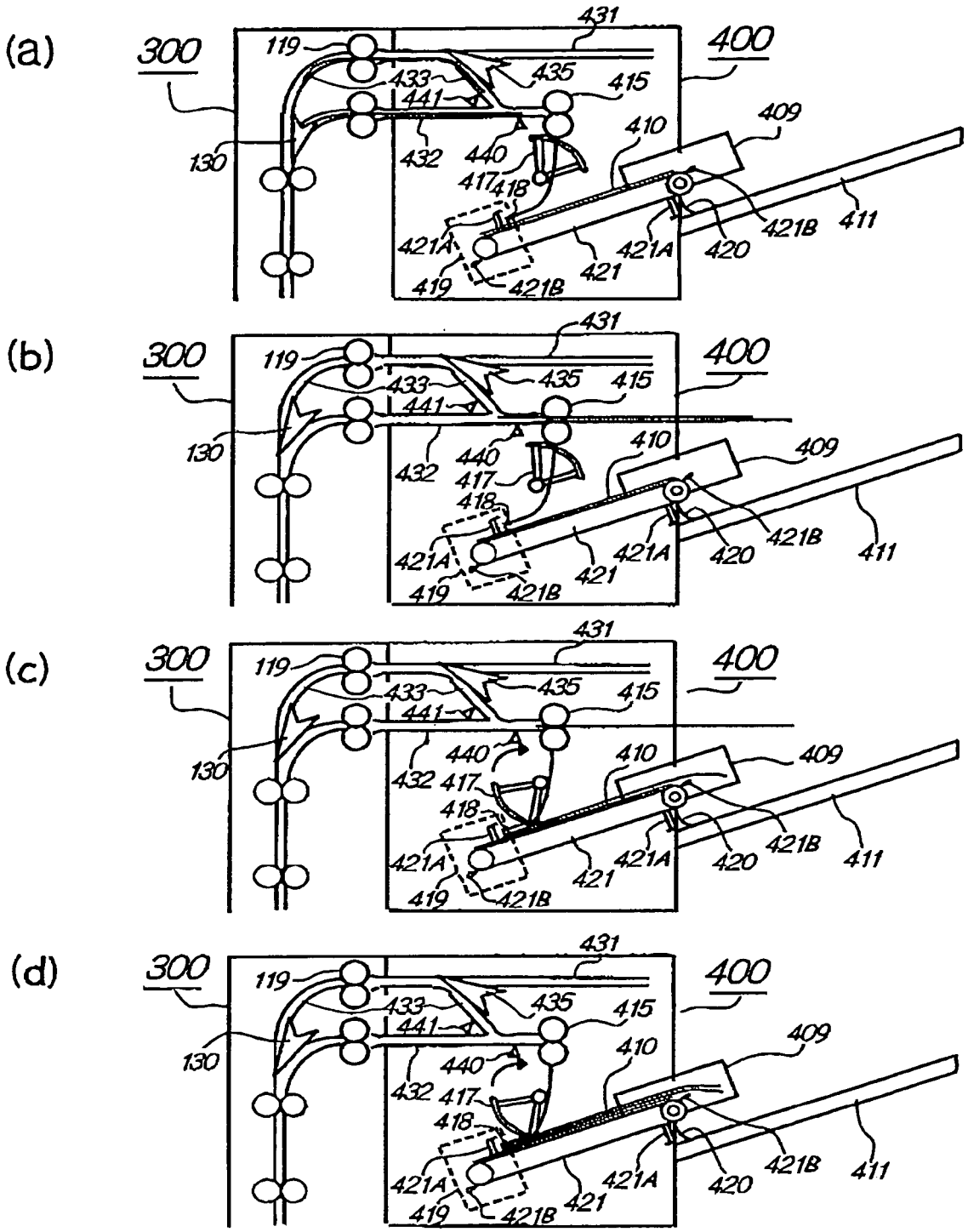
FIGS. 3A to 3D are views explanatory of a flow of a second set of sheets in the stapling processing.

Next, there will be illustrated a flow of a second set of two sheets. As shown in FIG. 3A, a first preceding sheet is conveyed onto the discharging path 432 by the first discharging rollers 118 by switching the flapper 130 serving as the first switching means; in the meantime, a second following sheet is conveyed onto the merging path 433 by the second discharging rollers 119 by switching the flapper 435. When a discharging path sensor 440 is turned on by the tip of the first sheet, the first discharging rollers 118 stop the conveying of the first sheet; in the meantime, when a merging path sensor 441 is turned on by the tip of the second sheet, the first discharging rollers 118 start the conveying of the first sheet. Thereafter, the first sheet and the second sheet are superimposed one on another, to be discharged onto the intermediate-processing tray 410 by the discharging rollers 415. Namely, in the present preferred embodiment, the discharging path 432 serves as a buffer path for allowing the preceding sheet to temporarily stay so as to superimpose the following sheet on the preceding sheet.

Although in the present preferred embodiment, the description has been given of the configuration in which the merging path 433 (i.e., the second conveying path) is disposed above the discharging path 432 (i.e., the first conveying path), the merging path 433 may be disposed under the discharging path 432. In this case, the preceding sheet is conveyed in face down onto the merging path 433 while the following sheet is conveyed in face down onto the discharging path 432, so that the sheets are discharged onto the intermediate-processing tray 410 in the proper order of pages. In other words, in this case, the merging path 433 serves as a buffer path for allowing the preceding sheet to temporarily stay so as to superimpose the following sheet on the preceding sheet.

Here, as shown in FIG. 3B, the discharging path sensor 440 is disposed downstream in the conveying direction beyond the merging path sensor 441. Therefore, assuming that the rotating speed of the first discharging roller 118 is the same as that of the second discharging roller 119, the first preceding sheet conveyed on the lower path advances more than the second following sheet in superimposition (i.e., in a state advancing in the conveying direction) in spite of the superimposition of the two sheets, and then, the two sheets are conveyed and discharged. In view of this, as shown in FIG. 3C, the rear end of the first sheet is separated from the discharging rollers 415 in advance, and then, the first sheet is discharged onto the intermediate-processing tray 410. Next, the tip of the sheet abuts against the stopper plate 418 by rotating the returning roller 417. Here, it is not always necessary to dispose the returning roller 417: namely, the sheet may be slid toward the stopper plate 418 on the intermediate-processing tray 410 by the effect of the inclination of the intermediate-processing tray 410. However, it is preferable that sheet returning means such as the returning roller 417 should be disposed in order to securely align the sheets.

Thereafter, as shown in FIG. 3D, the second sheet is discharged onto the intermediate-processing tray 410 by the discharging rollers 415, and then, the end of the sheet abuts against the stopper plate 418 by rotating the returning roller 417 again. In this manner, the set of two superimposed sheets abuts against the stopper plate, thereby achieving the alignment in the sheet conveying direction. An amount of lag between the first preceding sheet and the second following sheet is made as great as possible, or the discharging rollers 415 are temporarily stopped after the rear end of the first sheet is separated from the discharging rollers 415, thus securing the alignment in the sheet conveying direction by the returning roller 417. Here, it is necessary to determine the amount of lag within such a range as not to prevent the conveying of third or more sheets which are fed one by one without any buffering processing.

Subsequently, in the same manner as the first set of sheets, a set of sheets is aligned by the aligning plate 409, and then, the set of two sheets is subjected to the stapling processing in the staple unit 419. The sheet on the intermediate-processing tray 410 is discharged onto the stack tray 411 by the set discharging lever 421A.

As described above, a timing of discharge onto the intermediate-processing tray 410 is delayed by allowing the first sheet of the second set to temporarily stay so as to convey it in superimposition on a second sheet of the second set, thereby securing a time required for the stapling processing with respect to the first set of sheets. As a consequence, it is unnecessary to take a large interval of the image formation between the last sheet of the set to be subjected to the stapling processing and the first sheet of the next set, thus enhancing the productivity at the time of the stapling processing.

Furthermore, the rear end of the lower sheet out of the two superimposed sheets is made to advance more than the rear end of the upper sheet, thereby achieving the favorable alignment in the sheet conveying direction on the intermediate-processing tray 410. Incidentally, in the present preferred embodiment, the description has been given of the configuration in which the two sheets merge so as to be discharged in superimposition after the two sheets are fed onto the two sheet conveying paths, respectively. However, three or more sheets may be discharged in superimposition according to a time required for the sheet processing on the intermediate-processing tray 410. In such a case, the number of sheet conveying paths to be disposed need depend upon the number of sheets to be superimposed. Even in the case where three or more sheets are superimposed, the sheets fall onto the intermediate-processing tray 410 one by one in order from the lowermost sheet by discharging the sheets with an amount of lag in such a manner that the rear end of a lower sheet advances in the sheet conveying direction. At each time, the sheets are aligned in the sheet conveying direction, thereby achieving the favorable alignment.

Moreover, the sheet stacking device can be miniaturized without any need of a special buffer path by using the reversing path for the double-sided image formation as the buffer path, and thus, the device equipped with the buffering function can be incorporated inside of the image forming apparatus.

Here, in the above-described preferred embodiment, the description has been given of the configuration of the buffer unit including the first conveying path and the second conveying path which is branched from the first conveying path and merges again. However, the present invention is not limited to the above-described configuration. For example, the buffer unit may be constituted of a buffer roller for allowing a sheet to stay on a conveying path.

This application claims priority from Japanese Patent Application No. 2003-386394 filed Nov. 17, 2003, which is hereby incorporated by reference herein.

The invention claimed is:

1. A sheet stacking device which stacks sheets thereon, comprising:

a buffer unit which allows a preceding sheet to temporarily stay so as to superimpose the preceding sheet and a following sheet one on another;

a sheet discharging roller which discharges the sheets superimposed in the buffer unit; and a sheet stacker which stacks the sheets discharged from the buffer unit;

wherein the sheets to be discharged in superimposition by the sheet discharging roller are superimposed in a state in which a rear end of a lower sheet in a sheet conveying and a control that discharges the sheets to the sheet stacker one by one in order from the lower sheet.

2. A sheet stacking device according to claim 1, wherein the buffer unit includes:

a first conveying path, on which the sheet is conveyed;

a second conveying path which is branched from the first conveying path, and then, merges with the first conveying path again; and a first switching flapper which switches the sheet conveying direction between the first and second conveying paths;

wherein a preceding sheet is made to temporarily stay on one of the first and second conveying paths, to be then superimposed on a following sheet conveyed on the other conveying path by switching the first switching flapper.

3. A sheet stacking device according to claim 2, wherein the second conveying path is disposed above the first conveying path, and the first switching flapper is switched in such a manner as to guide the preceding sheet onto the first conveying path while to guide the following sheet onto the second conveying path.

4. A sheet stacking device according to claim 3, wherein the preceding sheet and the following sheet are superimposed in face down.

5. A sheet stacking device according to claim 2, wherein the second conveying path is provided with a reversing path which is branched before the second conveying path merges with the first conveying path.

6. A sheet stacking device according to claim 5, wherein the second conveying path is provided with a second switching flapper which selectively guides the sheet to the reversing path.

7. An image forming apparatus comprising:

image forming means which forms an image on a sheet; and the sheet stacking device as claimed in any one of claims 1 to 6, which stacks a sheet having an image formed thereon, the sheet stacking device being disposed above the image forming means.

* * * * *

UNITED STATES PATENT AND TRADEMARK OFFICE

CERTIFICATE OF CORRECTION

PATENT NO. : 7,111,839 B2
APPLICATION NO. : 10/986995
DATED : September 26, 2006
INVENTOR(S) : Shunsuke Nishimura It is certified that error appears in the above-identified patent and that said Letters Patent is hereby corrected as shown below:

COLUMN 7:
Line 17, "conveying" should read --conveying direction advances in the sheet conveying direction more than a rear end of an upper sheet,--.

Signed and Sealed this

Fifth Day of June, 2007

JON W. DUDAS
*Director of the United States Patent and Trademark Office*